US009394507B2

(12) United States Patent
Reinke et al.

(10) Patent No.: US 9,394,507 B2
(45) Date of Patent: Jul. 19, 2016

(54) BIODIESEL EMULSION FOR CLEANING BITUMINOUS COATED EQUIPMENT

(71) Applicants: A.L.M HOLDING COMPANY, Onalaska, WI (US); ERGON ASPHALT & EMULSIONS, INC., Jackson, MI (US)

(72) Inventors: Gerald Reinke, La Crosse, WI (US); Gaylon Baumgardner, Jackson, MI (US); David Cramer, La Crosse, WI (US)

(73) Assignees: ALM Holding Company, Onalaska, WI (US); Ergon Asphalt & Emulsions Inc., Jackson, MS (US)

( * ) Notice: Subject to any disclaimer, the term of this patent is extended or adjusted under 35 U.S.C. 154(b) by 0 days.

(21) Appl. No.: 14/406,338

(22) PCT Filed: Jun. 5, 2013

(86) PCT No.: PCT/US2013/044220
§ 371 (c)(1),
(2) Date: Dec. 8, 2014

(87) PCT Pub. No.: WO2013/184746
PCT Pub. Date: Dec. 12, 2013

(65) Prior Publication Data

US 2015/0152358 A1 Jun. 4, 2015

Related U.S. Application Data

(60) Provisional application No. 61/657,268, filed on Jun. 8, 2012.

(51) Int. Cl.

| | |
|---|---|
| ***C11D 3/43*** | (2006.01) |
| ***C11D 3/06*** | (2006.01) |
| ***C11D 3/382*** | (2006.01) |
| ***C11D 7/36*** | (2006.01) |
| ***C11D 7/44*** | (2006.01) |
| ***C11D 7/50*** | (2006.01) |
| ***C11D 3/38*** | (2006.01) |
| ***C11D 3/18*** | (2006.01) |
| ***C11D 1/88*** | (2006.01) |
| ***B08B 3/10*** | (2006.01) |
| ***C11D 3/36*** | (2006.01) |

(52) U.S. Cl.
CPC . *C11D 3/38* (2013.01); *B08B 3/102* (2013.01); *C11D 1/886* (2013.01); *C11D 3/18* (2013.01); *C11D 3/365* (2013.01)

(58) Field of Classification Search
CPC ..... C11D 3/43; C11D 1/347; C11D 3/06; C11D 3/2093; C11D 3/221; C11D 3/382; C11D 3/393; C11D 7/36; C11D 7/44; C11D 7/50; C11D 7/5004; C11D 11/0023; C11D 11/0029; C11D 17/0017
See application file for complete search history.

(56) References Cited

U.S. PATENT DOCUMENTS

| | | | | |
|---|---|---|---|---|
| 5,431,719 | A * | 7/1995 | Clapp | A23D 7/0053 106/2 |
| 2003/0004079 | A1 | 1/2003 | Aigner et al. | |
| 2005/0197267 | A1 | 9/2005 | Zaki et al. | |
| 2005/0232953 | A1* | 10/2005 | Barnikol | A61K 8/064 424/400 |
| 2005/0255126 | A1* | 11/2005 | Tsubaki | A21D 2/18 424/195.16 |
| 2006/0162237 | A1 | 7/2006 | Mullay et al. | |
| 2011/0091556 | A1* | 4/2011 | Baker, Jr. | A61K 9/1075 424/489 |
| 2011/0219983 | A1 | 9/2011 | Baseeth et al. | |
| 2015/0152363 | A1* | 6/2015 | Troxler | C11D 1/526 560/71 |
| 2015/0275121 | A1* | 10/2015 | Goldman | C09K 8/524 508/431 |

OTHER PUBLICATIONS

International Search Report, PCT/US2013/044220, mailed Oct. 29, 2013.

* cited by examiner

*Primary Examiner* — Charles Boyer
(74) *Attorney, Agent, or Firm* — Kagan Binder, PLLC

(57) ABSTRACT

Methods of cleaning equipment such as hand tools dirtied by bituminous mixture. A biodiesel emulsion comprising biodiesel, water and emulsifier(s), is applied to the surface of the equipment for a period of time (e.g., at least about 15 minutes) and optionally agitated. The biodiesel emulsion produces cleaning properties comparable to straight biodiesel, at a cost reduction, due to the replacement of biodiesel with water.

12 Claims, No Drawings

BIODIESEL EMULSION FOR CLEANING BITUMINOUS COATED EQUIPMENT

CROSS-REFERENCE TO RELATED APPLICATION

This application claims the benefit from International Application No. PCT/US2013/044220, filed Jun. 5, 2013, which in turn claims the benefit of U.S. Provisional Application No. 61/657,268 filed on Jun. 8, 2012, the entire contents of which are incorporated herein by reference for all purposes.

BACKGROUND

During the process of constructing bituminous pavements hand tools such as rakes (referred to as lutes), shovels, and scrapers become coated with the bituminous mixture. Common practice in the industry is to have a container of fuel oil (typically #2 diesel fuel, light cycle oil or kerosene) or some other such solvent attached to the side of paving machine into which the bituminous coated tools can be placed and allowed to passively soak clean. Alternatively, after a period of soaking, the tools can be scraped clean using a putty knife due to the softening effect of the fuel oil or solvent on the bituminous paving mixture.

The petroleum derived fuel oils used to soften and remove bituminous mixture coated hand tools can contain carcinogenic substances and due to the general practice of using the hand tools without gloves the handling of the bituminous mixture coated hand tools there is a greater risk of these carcinogenic substances being absorbed into the bodies of workers.

Better, more environmentally friendly, cleaning methods are needed.

SUMMARY

This disclosure describes the use of biodiesel emulsions for cleaning bituminous materials (e.g., asphalt binder) from objects. The emulsified composition, comprising biodiesel, water and emulsifier(s), provides comparable cleaning properties to straight biodiesel. The emulsifier(s) may be lecithin-based or non-lecithin-based. Additionally, a lecithin source, having a low hydrophilic-lipophilic balance (HLB) (e.g., about 2-6 HLB) may be added to facilitate formation of the emulsified biodiesel composition.

In one embodiment of the present invention, bituminous dirtied equipment is cleaned with an inverted biodiesel emulsion comprising biodiesel, water, and at least one emulsifier. At least one emulsifier may be lecithin-based, and may have a low hydrophilic-lipophilic balance (e.g, about 2-6 HLB). In some embodiments, a combination of more than lecithin-bases emulsifiers (with HLB values in the about 2-6 range) are used.

In another embodiment of the present invention, bituminous dirtied equipment is cleaned with an inverted biodiesel emulsion by soaking the equipment in the biodiesel emulsion, preferably with agitation of either the emulsion, the equipment, or both.

DETAILED DESCRIPTION OF THE INVENTION

The present disclosure provides methods of cleaning equipment such as hand tools dirtied by bituminous mixture. In accordance with the invention, a biodiesel emulsion comprising biodiesel, water and emulsifier(s), is applied to the surface of the equipment. The equipment is typically exposed to the biodiesel emulsion for a period of time (e.g., at least about 15 minutes) optionally with agitation of either the equipment or the emulsion. The biodiesel emulsion produces cleaning properties comparable to straight biodiesel, at a cost reduction, due to the replacement of some fraction of the biodiesel with water.

Biodiesel is a product derived from 100% vegetable oils or animal fats, including post-consumer waste oils. Biodiesel is the transesterification product of fatty lipids in the oil with short chain alcohols (typically methyl, ethyl or propyl). Biodiesel is considered a 'green' technology, and can be used in many applications as a direct replacement for petroleum diesel. Biodiesel is available as 100% biodiesel ("B100") or blended with conventional petroleum diesel (e.g., "B20", which is 20% biodiesel and 80% petroleum diesel). Either biodiesel or biodiesel blends may be used in the emulsions and methods of this invention. For embodiments where a 'green' product and method is desired, pure biodiesel is used.

Applicants have found that an inverted biodiesel emulsion is a good replacement for petroleum derived solvents for the cleaning of bituminous mixture coated equipment, such as hand tools. The use of biodiesel eliminates the potential for exposure to the carcinogens found in the petroleum-derived solvents typically used. Laboratory testing has confirmed that the incorporation of water into the biodiesel in the form of a water in oil emulsion can substantially reduce the cost of the cleaning solvent with no apparent loss in the cleaning ability of the biodiesel product.

The biodiesel emulsion of this invention is a water in oil emulsion (i.e., an inverted emulsion) comprising biodiesel, water and at least one emulsifier. The emulsifier may be lecithin-based or non-lecithin-based; a combination of lecithin-based emulsifiers, a combination of non-lecithin-based emulsifiers, or a combination of lecithin-based and non-lecithin based emulsifiers may be used. The emulsifier may have a low hydrophilic-lipophilic balance (HLB) (e.g., about 2-6 HLB) or a higher HLB. In some embodiments, a combination of a low HLB emulsifier and a high HLB emulsifier is used.

The hydrophilic-lipophilic balance (HLB) of a compound, such as an emulsifier, is a measure of the degree to which it is hydrophilic or lipophilic, and is determined by calculating those values for the different regions of the molecule. In general, an HLB value less than 10 indicates the compound is lipid soluble (i.e., essentially water insoluble).

An example of a low HLB lecithin-based emulsifier particularly suited to produce stable inverted emulsions of biodiesel is "Actiflo 70-SB" from Central Soya Co., Inc., now available as "Solec 70-SB" from Solae, LLC after Solea acquired the product from Central Soya Co. An example of a higher HLB lecithin-based emulsifier particularly suited to produce stable inverted emulsions of biodiesel is "Centrol 3F-UB" from Central Soya Co., Inc., now available as "Solec 3F-UB" from Solae, LLC after Solea acquired the product from Central Soya Co. Of course, other dispersant lecithin surfactants, emulsifiers or their blends are also expected to produce stable inverted emulsions of biodiesel, as well as other sources of lecithin with the desired HLB (typically 2-6). Lecithin-based emulsifiers have been shown (as reported in the Examples section) to produce stable water in biodiesel emulsions. By describing an emulsion as "stable", what is meant is that the biodiesel and the water do not phase separate within 24 hours after stopping the mixing of the materials.

It is also expected that non-lecithin water in oil emulsifiers will produce stable inverted emulsions of biodiesel, but a small sampling of such emulsifiers (as reported in the Examples section) failed to produce stable water in biodiesel emulsions. The sampling of emulsifiers tested was not a result of an exhaustive search for non-lecithin surfactants capable of producing stable water in biodiesel emulsions, and it is still believed that, at some formulation, non-lecithin-based emulsifiers are capable of producing stable water in oil emulsions.

The amount of emulsifier, as a weight percent of the biodiesel in the resulting emulsion, is at least 0.5-wt-%, in most embodiments at least 1 wt-%. When a combination of two or more emulsifiers is used, preferably each of the emulsifiers is present as at least 0.5 wt-% of the biodiesel. When a combination of two or more emulsifiers is used, their respective amounts may be the same or different.

In a particular embodiment, a water in diesel emulsion includes 1 to 2 wt-% of either "Actiflo 70-SB" (or "Solec 70-SB") or "Centrol 3F-UB" (or "Solec 3F-UB"). In other embodiments, the emulsion includes a combination of 1 wt-% to 2 wt-% of each of "Actiflo "Actiflo 70-SB" (or "Solec 70-SB") and "Centrol 3F-UB" (or "Solec 3F-UB").

The amount of water, as a volume percent of the entire emulsion, is at least 5 vol-% and preferably at least 10 vol-%. Having as little as 10 vol-% water in the emulsion provides cost savings, due to the reduced amount of biodiesel needed for the same volume of cleaning fluid. The greater amount of water in the emulsion the more preferred, due to the cost savings from the reduced amount of biodiesel. Emulsions with as much as 40 vol-% water have shown cleaning properties comparable to straight biodiesel. It is expected that stable emulsions with 50 vol-% water will also produce cleaning properties comparable to straight biodiesel.

Even though the present invention provides stable inverted emulsions, because water is denser than biodiesel and the water droplets are in the micron size range, some of the biodiesel will slowly cream to the top of the emulsion in a storage container. Below that layer of biodiesel there will be a more highly water concentrated inverted emulsion. This is not the same as a broken emulsion because the two layers are easily remixed. A sample of the lower layer when added to water it will not disperse because the biodiesel is still the continuous phase. If the emulsion had broken and if water was on the bottom then that lower later would readily disperse in water. The emulsions described herein as 'broken' or 'unstable' have complete separation of the water from the biodiesel.

The stable, water-in-biodiesel emulsions, in accordance with this invention, are used to remove bituminous material (e.g., asphalt, asphalt binder, asphalt coated mineral matter, etc.) from equipment and tools, such as those used during a paving or repaving process. The bituminous material that can be removed by the water-in-oil diesel emulsion may be any known mixture, including polymer modified asphalts, amine-modified asphalts, mastic asphalt, etc. The bituminous material may be natural or manufactured. Aggregate or sand may or may not be present in the bituminous material being cleaned from the equipment.

To cleanse equipment (such as hand tools) dirtied with bituminous material, the equipment is exposed to the biodiesel emulsion, preferably completely covered with or immersed in the emulsion. In most embodiments, immersing the equipment in a large volume of biodiesel emulsion (e.g., in a bucket, tub, barrel, or other container) is the most effective. The biodiesel softens the bituminous material and, over time, dissolves at least a portion of the material. Immersion (soaking) in the biodiesel emulsion for at least about 30 minutes, and in some embodiments in as little as 15 minutes, produces noticeable softening of the material. Manual removal (e.g., scraping) of bituminous material off the equipment is more readily done after softening in the biodiesel. Depending on the amount and type of bituminous material on the equipment, immersion for 1 hour (60 minutes) may be sufficient to dissolve the material and provide clean equipment without the need for scraping.

Agitation may be provided to either the emulsion or the equipment during the immersion period to facilitate the softening and/or removal of the bituminous material. The agitation may be purposely provided, such as by a vibrator table, stirring rod or the like, or the agitation may be inherent, such as due to vibration from a vehicle on which the bucket or container is positioned. Merely tossing in and removing equipment (e.g., hand tools) from the bucket or container will provide agitation. Although not intending to be bound by theory, agitation of the emulsion may provide both chemical and mechanical cleaning action.

In some situations, the biodiesel emulsion is formed prior to use (hence, the desire to have it be a stable emulsion). As an example, the biodiesel emulsion may be formed and then transported to a paving job site, where it is poured into an appropriate container or bucket. Alternately, in other situations, the biodiesel emulsion is formed on-site or in close proximity to the paving site, immediately or soon before use. For example, the biodiesel emulsion could be produced at the facility producing the bituminous paving mixture for a given project.

EXAMPLES

The following describes the preparation of biodiesel emulsions and their testing as a cleaner of bituminous material.

Procedure for Preparing Biodiesel Emulsions

1. Measure out 100% biodiesel into a container; record both mass and volume
2. Using the wt-% of the emulsifiers being used, calculate the mass of each emulsifier: mass emulsifier=(mass of biodiesel)/(wt-% of biodiesel in emulsion)×wt-% of emulsifier in emulsion
3. Using the volume-% of the water to be added, calculate the volume of water required: volume of water=(volume of biodiesel)/(vol-% of biodiesel in emulsion)×vol-% of water in emulsion
4. Add the emulsifier to the container with the biodiesel Note: If both emulsifiers ("Actiflo 70-SB" or "Solec 70-SB" and "Centrol 3F-UB" or "Solec 3F-UB") are used, add the "Actiflo 70-SB" or "Solec 70-SB" first
5. Using a Ross model ME-100L disperser with fine mesh homogenizing screen, blend the emulsifier(s) and biodiesel for about 2 minutes Note: Make sure the mixer head is submerged
6. Using warm water, slowly add the calculated volume of water to the container with the Ross disperser engaged Note: It may be necessary to adjust the speed of the disperser during addition of the water
7. Allow shearing with the disperser to continue for 5 minutes
8. Turn off the disperser and transfer the resulting emulsion into a labeled container for storage Table 1, below, summarizes the biodiesel emulsions made by the procedure described above. The emulsifiers used were lecithin-based emulsifiers, "Actiflo 70-SB" (or "Solec 70-SB") and optionally "Centrol 3F-UB" (or "Solec 3F-UB"). Test equipment (spatulas with 6 inch blade length) was dirtied with the asphalt mix described below. The dirtied test equipment was introduced in the prepared biodiesel emulsions and soaked for varying periods of time. After soaking, the amount of asphalt mix removed by the soaking was calculated and compared to a 100% biodiesel control.

TABLE 1

| Sample # | % Actiflo 70-SB or Solec 70-SB by wt of biodiesel | % Central 3F-UB or Solec 3F-UB by wt of biodiesel | Volume-% of water in final emulsion |
|---|---|---|---|
| 1 | 5 | 0 | 24 |
| 2 | 1 | 1 | 10 |
| 3 | 1 | 1 | 20 |
| 4 | 1 | 1 | 40 |
| 5 | 2 | 2 | 10 |
| 6 | 2 | 2 | 20 |
| 7 | 2 | 2 | 20 RS |
| 8 | 2 | 2 | 26 |
| 9 | 2 | 2 | 31 |
| 10 | 2 | 2 | 40 |
| 11 | 1 | 1 | 50 |

In Table 1 above, RS stands for a retaining shield that was added to the disperser to attempt to provide a finer dispersed water droplet size.

Procedure for Preparing Bituminous Asphalt Mix

1. Mass out an amount of ASTM 20-30 mesh sand into a heat resistant container
2. Separately, heat the sand and asphalt binder ("PG 64-22" from Imperial Oil) to 160° C.
3. Calculate the amount of asphalt binder required for the amount of sand: mass asphalt required=(mass of sand)/(wt-% of sand in mix)×wt-% of asphalt
4. Add the heated asphalt binder to the heated sand and stir until well mixed Procedure for Performing Cleaning Test 1. Label spatulas and vials; use only matching spatulas and vials together
2. Measure out and mark the vial for the first biodiesel emulsion sample at about 1⅜" (about 3.5 cm) from the top of the vial
3. Place the asphalt mix into an oven at 160° C.
4. Take the first biodiesel emulsion sample and ensure it is homogenous by repeatedly inverting the sample container, then fill the appropriate vial with the sample to the mark
5. Repeat step 4 for all samples using approximately equal volumes Note: Setting the vials side by side while filling or marking them all works well 6. Mass the clean spatula for a sample
7. Dip the spatula into the biodiesel emulsion sample vial allowing it to touch the bottom Note: Insert the spatula only part way so the sample does not coat more surface area than it would if the spatula was placed in the vial. Prior to performing this step it may be necessary to stir the sample because in the lower viscosity emulsions (10 and 20% water) settling of the dispersed water droplets can occur. The spatulas are wiped clean prior to being coated with the test asphalt mixture so that the spatulas do not retain a coating of biodiesel emulsion prior to coating with the asphalt mix.

8. Remove the spatula and gently shake it until no sample comes free
9. Mass the spatula with the adhered biodiesel emulsion sample
10. Repeat steps 7 through 9 four more times for a total of five replicates
11. Clean off the spatula using naphtha
12. Repeat steps 6 through 11 for the remaining samples
13. Remove the mix from the oven
14. Coat a spatula with a thin layer of the asphalt mix massing 3.5 g ±0.5 g
15. Without letting the asphalt mix touch a surface it will stick to, set spatula aside
16. Repeat steps 14 and 15 with the remaining samples
17. Allow the mix on the spatulas to cool to room temperature
18. Check the samples in the vials are still homogenized, stir with a glass rod if they are not making sure to wipe off the rod between samples to prevent contamination
19. Place the end of the spatula with the coating of asphalt mix into the matching vial for all the samples
20. Place the rack with the vials onto the bed of the orbital shaker
21. Turn on the orbital shaker and check that the settings are correct, then run the shaker
22. When the shaker has finished running, remove the first spatula and gently shake it till no sample comes free
23. Mass the spatula with the remaining sample and emulsion on it, then set it aside
24. Repeat steps 22 and 23 for all samples
25. Calculate the mass of the emulsion that adhered to the spatula using the average of the five replicates and the percent of mix removed taking into account the emulsion still on the spatula Test Calculations Mass of emulsion adhered=(average mass of spatula with emulsion adhered)−(mass of clean spatula)

Mass of mix on spatula=(mass of dirty spatula)−(mass of clean spatula)

Mass of mix removed during test=(mass of dirty spatula)−(mass of spatula after cleaning)

Percent mix removed=(mass of mix removed during test)/(mass of mix on spatula)

Results

The results from the cleaning tests are summarized in Table 2 below; only one set of tests was performed with a static soak after which it was concluded that equipment introduced into a tank containing cleaning solution would not be static, but rather agitated as the equipment was moved in and out of the tank. The orbital shaker idea was then introduced to simulate more closely the action expected in actual practice.

TABLE 2

Cleaning efficiency of biodiesel emulsions (results are percent of mix removed)

| Sample # | Static soak 2 hrs | Orbital Shaker Speed 75 1 hr | Orbital Shaker Speed 75 2 hrs | Orbital Shaker Speed 115 0.5 hr | Orbital Shaker Speed 115 1 hr |
|---|---|---|---|---|---|
| Control - 100% biodiesel | 98.3% | 71.4% | 101.7% | 45.7% | 82.3% |
| 2 | — | 90.0% | 92.2% | 24.2% | 69.7% |

TABLE 2-continued

Cleaning efficiency of biodiesel emulsions (results are percent of mix removed)

| Sample # | Static soak 2 hrs | Orbital Shaker Speed 75 1 hr | Orbital Shaker Speed 75 2 hrs | Orbital Shaker Speed 115 0.5 hr | Orbital Shaker Speed 115 1 hr |
|---|---|---|---|---|---|
| 3 | — | 97.7% | 96.1% | 42.3% | 67.6$ |
| 4 | — | 79.4% | 112.9% | 55.6% | 87.4% |
| 5 | — | 86.5% | 92.8% | 61.8% | 66.3% |
| 6 | — | — | 95.6% | 41.7% | — |
| 7 | — | — | — | — | 69.4% |
| 8 | 83.3% | 50.9% | — | — | — |
| 9 | 99.4% | 50.6% | 86.5% | 40.0% | 80.0% |
| 10 | — | 40.6% | 86.3% | 42.9% | 69.4% |

The final calculation of percent asphalt mix removed is adjusted based on the amount of test emulsion adhering to the clean spatula as discussed above. If the amount of test liquid that actually adheres to a spatula after the cleaning procedure is less than the amount determined on the clean or blank spatula then the resultant calculation will overstate percent removed. For example, for the 112.9% removed value, the blank spatula had an average of 1.04 grams of test emulsion adhered; if the actual amount that adhered after the cleaning test was only 0.4 grams the calculated amount removed would have been 94.1%, if zero grams had been adhered the calculated amount removed would have been 82.4%. There will always be some test liquid retained, so this procedure makes a reasonable adjustment for the mass of biodiesel emulsion retained on the spatulas after the cleaning step.

It was expected that the 100% biodiesel control sample would always provide the best performance, however that was not the case. For the shortest immersion time (which is most representative of field behavior) all of the emulsion samples (with the exception of sample #2) performed comparably or better than the 100% biodiesel control. Across all of the different cleaning scenarios, sample #4 (having 1% of each surfactant and 40% water) performed unexpectedly well. The samples with 10% and 20% water by volume (i.e., samples #2, #3, #5, #6 and #7) were expected to perform well, or at least comparable to the control, because of the lower level of water and thus higher level of biodiesel; while these samples generally did achieve the goal of being comparable to the 100% biodiesel, this was accomplished with a substantial decrease in the amount of biodiesel employed.

Table 3, below, summarizes additional biodiesel emulsions made by the procedure described above. The emulsifiers used for this set of tests were non-lecithin-based emulsifiers: glycerol monooleate; "Petrosul 60", a petroleum sulfonate from Calumet Specialty Products Partners, L.P.; "BIO SOFT LD-95", an alpha olefin sulfonate from Stepan Co.; and "AS-1", an asphalt antistripping additive from MeadWestvaco. (It is noted that all of these emulsifiers have been used to produce inverted emulsions with petroleum based oils such as #6 residual oil or clarified slurry oil). Each of the samples was formed with 350 mL biodiesel, 1% or 2% emulsifier (as a weight percent of biodiesel) and 40% water by volume. These compositions were prepared in the same manner as described above.

TABLE 3

| Sample # | Emulsifier | Observations |
|---|---|---|
| 12 | 2 wt-% Glyceryl monooleate | Emulsion broke quickly, contained a lot of bubbles, and eventually resulted in a clear-opaque bottom layer, a bright white remnant bubble layer in the middle, and a cloudy yellow top |
| 13 | 1 wt-% Petrosul 60 | Emulsion broke over a 24 hour period, eventually resulted in a clear-opaque layer on the bottom, a very white with tan cream middle layer, and a cloudy yellow top layer |
| 14 | 2 wt-% Petrosul 60 | Emulsion separated slower than the 1 wt-% version (sample #13), but eventually did break after a 24 hour period |
| 15 | 2 wt-% LD95 | Emulsion broke quickly, contained a lot of bubbles, and eventually resulted in a clear-opaque bottom layer, a bright white middle layer, and a cloudy yellow top layer |
| 16 | 2 wt-% AS-1 | Emulsion began to break immediately after mixing stopped, and resulted in three distinct layer, then two layers with the emulsifier in the oil layer |

Table 3 shows that none of the tested surfactants were successful in producing a viable water in biodiesel emulsion at the level of 40% dispersed water by volume. However, it is expected that stable inverted emulsions of biodiesel could be produced, either with other surfactants/emulsifiers, at different surfactant/emulsifier levels, and/or at different water levels.

Thus, embodiments of BIODIESEL EMULSION FOR CLEANING BITUMINOUS COATED EQUIPMENT are disclosed. The implementations described above and other implementations are within the scope of the following claims. One skilled in the art will appreciate that various modifications and additions can be made to the exemplary embodiments discussed without departing from the scope of the present invention. For example, while the embodiments described above refer to particular emulsion features, the scope of this invention also includes embodiments having different combinations of features. The disclosed embodiments are presented for purposes of illustration and not limitation, and the present invention is limited only by the claims that follow.

The invention claimed is:

1. A method of cleaning equipment dirtied by bituminous material, the method comprising:

forming a stable, water in oil emulsion comprising biodiesel, 1 to 4 wt-% lecithin-based emulsifier based on the biodiesel weight, and water;

exposing the dirtied equipment to the emulsion for a period of time and agitating either the emulsion or the equipment; and removing clean equipment from the emulsion.

2. The method of claim 1, wherein the lecithin-based emulsifier comprises biodiesel, a first lecithin-based emulsifier, a second lecithin-based emulsifier, and water.

3. The method of claim 2, wherein the first lecithin-based emulsifier has a low HLB.

4. The method of claim 3 wherein the first lecithin-based emulsifier has a 2 to 6 HLB.

5. The method of claim 3, wherein the second lecithin-based emulsifier has a higher HLB than the first lecithin-based emulsifier.

6. The method of claim 2, wherein the first lecithin-based emulsifier is present at a level of 1 to 2 wt-% based on the biodiesel weight.

7. The method of claim 1, wherein the emulsion comprises at least 10 vol-% water.

8. The method of claim 1, wherein the emulsion comprises at least 20 vol-% water.

9. The method of claim 1, wherein the emulsion comprises at least 40 vol-% water.

10. The method of claim 1, wherein the step of forming a stable, water in oil emulsion comprises:

combining the emulsifier with the biodiesel to form an intermediate mixture at a first location, and combining the water with the intermediate mixture at a second location.

11. A method of cleaning equipment dirtied by bituminous material, the method comprising:

forming a stable, water in oil emulsion comprising biodiesel, 1 to 4 wt-% lecithin-based emulsifier based on the biodiesel weight, and at least 10 volume % water;

immersing the dirtied equipment in the emulsion for a period of time; and removing clean equipment from the emulsion, the clean equipment being comparably clean to equipment immersed in pure biodiesel.

12. The method of claim 11, wherein the step of immersing the dirtied equipment in the emulsion for a period of time comprises soaking the dirtied equipment in the emulsion for at least 15 minutes.

* * * * *